222-464 SR
10/22/85 OR 4,548,344

United States Patent [19]
Hestehave et al.

[11] Patent Number: 4,548,344
[45] Date of Patent: Oct. 22, 1985

[54] ADAPTOR ASSEMBLY FOR JERRY CANS AND STORAGE DRUMS

[75] Inventors: Borge Hestehave, Alta Loma; Kjeld Hestehave, Upland, both of Calif.

[73] Assignee: Bomatic, Inc., Ontario, Calif.

[21] Appl. No.: 505,713

[22] Filed: Jun. 20, 1983

[51] Int. Cl.[4] ..... B67D 5/60
[52] U.S. Cl. ..... 222/464; 222/382; 222/525; 222/527; 222/539; 222/568
[58] Field of Search ..... 222/568, 527, 539, 464, 222/211, 538, 525, 526, 567, 382, 502, 522, 523, 545, 567; 220/287, 288; 285/174

[56] References Cited

U.S. PATENT DOCUMENTS

| | | | |
|---|---|---|---|
| 2,223,012 | 11/1940 | Wanderski et al. | 222/527 |
| 2,576,740 | 11/1951 | Wilson | 222/382 |
| 2,651,440 | 9/1953 | Hobbs . | |
| 2,818,201 | 12/1957 | Peck | 222/382 |
| 3,002,699 | 10/1961 | Pinke | 222/382 |
| 3,050,218 | 8/1962 | Harvey . | |
| 3,324,903 | 6/1967 | Hinz | 222/464 |
| 3,372,846 | 3/1968 | Berkus | 222/479 |
| 4,135,744 | 1/1979 | Fouts | 285/174 |

*Primary Examiner*—Joseph J. Rolla
*Assistant Examiner*—Andrew Jones
*Attorney, Agent, or Firm*—Sixbey, Friedman & Leedom

[57] ABSTRACT

An adaptor assembly that is designed to enable pumping of liquids, such as fuel, from large capacity drums of the type having openings that are sealable by a threaded bung-type closure; pouring of liquids, such as fuel, from military-type Jerry Cans; pumping of liquids, such as fuel, from military-type Jerry Cans; and pumping of fuels from small capacity commercial-type containers of the type designed to receive internally threaded closure caps. The adaptor assembly, in accordance with a preferred embodiment, comprises a large diameter container cap that is designed for mating with a standardized container opening and a small diameter coupling cap, and for slideably and detachably receiving a tubular spout. The coupling cap carries a pump connector and a tubing connector projecting from each of top and bottom sides thereof, and to which flexible tubing is coupled. The tubing connector and flexible tubing, including clamps for securing same together, are sized so that they may be received within a tubular spout mounting projection of the large diameter cap, when the tubular spout is removed, and a small diameter coupling cap is threaded onto the large diameter coupling cap.

5 Claims, 9 Drawing Figures

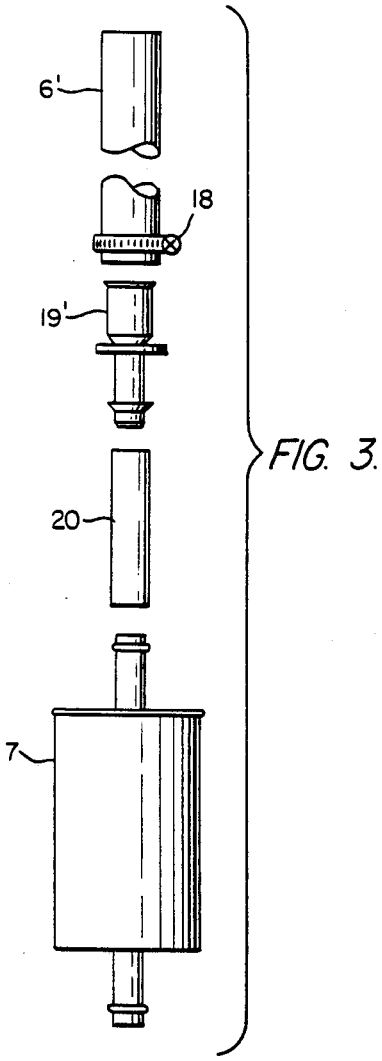
FIG. 3.
FIG. 4.
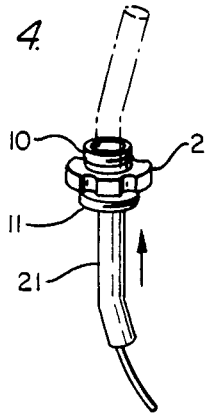
FIG. 5.
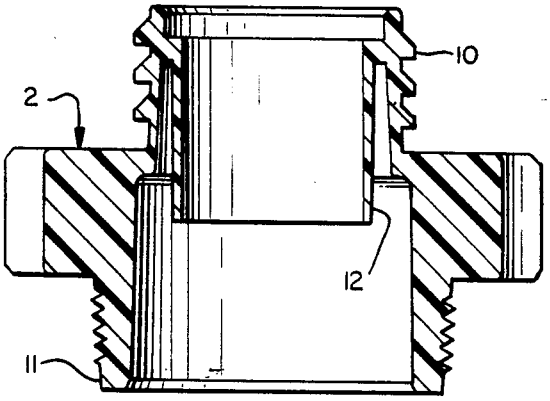
FIG. 6.
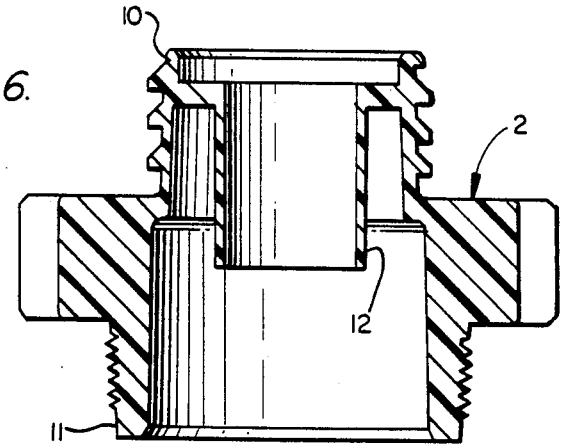

5
3
6
C
G

5'
27
26
16
13
15
1'
25
14

ADAPTOR ASSEMBLY FOR JERRY CANS AND STORAGE DRUMS

BACKGROUND OF THE INVENTION

The present invention relates to an adaptor assembly for threaded openings of containers for liquids, and, in particular, to an adaptor assembly for use with fuel containers of the type used by the military services for a variety of purposes, such as the storage and refueling of mechanized equipment in the field, which may serve not only as a container closure, but also as both a pouring and pumping adaptor therefor.

For military purposes, large quantities of fuel are typically stored in 55 gallon drums, while smaller quantities of fuel are stored in portable 5 gallon containers of the type commonly known as Jerry Cans. Both of these types of containers utilize the same size, internally threaded, opening which is sealable by a complementarily shaped, externally threaded bung-type closure. Pumps are often utilized to deliver fuel from either of these types of containers to either vehicles or fuel powered machinery, such as electrical generators. Additionally, Jerry Can type containers are also utilized to supply fuel by gravity pouring of the contents of the Jerry Can into the fuel tank of a vehicle or other equipment.

Arrangements for pumping of fuels from containers are known, as are adaptors to facilitate pouring of fuel from Jerry Can type containers. U.S. Pat. No. 2,651,440 discloses a gravity feed type adaptor for Jerry type cans, but this adaptor is not utilizable with drum-type containers which do not have a handle, nor is this adaptor designed for use with both a pour spout and a pumping arrangement. Likewise, a pumping assembly is known from U.S. Pat. No. 3,050,218, which utilizes a pumping cap member that is attached to an external thread of one size that is located on a first end of an adaptor component, which adaptor component has a different thread size at an opposite end for engagement within a complementarily shaped bung hole type opening in the top of a drum. However, this pumping adaptor arrangement is neither intended nor suitable for use with a pour spout.

On the other hand, while dual-cap type closures, which are provided with retractable pour spouts, are known for commercial-type small capacity (1 to 2½ gallon) portable gas cans from U.S. Pat. No. 3,372,846 and commonly assigned, pending U.S. application Ser. No. 259,165, filed Apr. 30, 1981, such have not, heretofore, been utilized in connection with military fuel storage containers, nor have they been designed for use as an adaptor for pumping purposes.

SUMMARY OF THE INVENTION

It is an object of the present invention to provide an adaptor assembly which may be coupled to a standardized container opening in order to enable discharge of the contents thereof by way of either pumping or pouring from a retractable and detachable spout, and, in particular, to provide such an assembly for use with standardized military fuel drum and Jerry Can type containers.

It is a further object of the present invention to provide an adaptor assembly for standardized military fuel containers which have parts that are interchangeable with commercial non-military spout assemblies.

Therefore, in accordance with preferred embodiments of the present invention, an adaptor assembly is provided which comprises a large diameter, container cap that has a top and a bottom externally threaded tubular projection extending in axial alignment from opposite sides thereof, the top threaded projection being of a lesser diameter than the bottom threaded projection. The top projection is also provided with a spout mounting projection that is directed internally toward the bottom projection. A tubular spout is provided which is sized and shaped for retention within the spout mounting projection in a manner permitting slideable movement thereof between a retracted position, wherein the spout projects outwardly from the bottom projection of the container cap, and a pouring position, wherein the spout projects outwardly from the top projection of the container cap. With the tubular spout removed, the assembly is usable for pumping purposes, by the provision of a small diameter, coupling cap that has an internally threaded peripheral wall which is sized and shaped for threadingly seating upon the threads of the top projection of the container cap. An aperture is provided extending concentrically therethrough, and a pump connector and a tubing connector project, respectively, from each of top and bottom sides of the coupling cap in alignment with this aperture. A flexible tubing is coupled to the tubing connector by clamping means, and the pumping connector is designed for connection to a pump by appropriate tubing. The flexible tubing that is coupled to the tubing connector and the clamping means securing same are sized so as to be received within the spout mounting projection of the container cap, when the coupling cap is seated upon the top projection thereof and the spout removed.

Preferably, additional selectively usable lengths of flexible tubing are provided for adaption of the assembly for use with containers of different heights, and an optional fuel filter is provided for use by connection to an end of the flexible tubing or the additional flexible tubing, when circumstances of use so warrant.

Still further, in accordance with preferred embodiments, the bottom projection of the container cap is sized for mating with standardized military fuel drum and Jerry Can bung holes, while the internal threading of the coupling cap corresponds to that of the opening of a non-military gas container, whereby the coupling cap can be utilized, without the container cap, for pumping from the non-military container, and a standard non-military cap is usable on the top projection of the container cap for closing same with the spout retained therein.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 3 is an exploded view of an optional fuel-filter sub-assembly of the adaptor assembly of the present invention;

FIG. 4 is an illustration of a large diameter, container cap and tubular spout slideable therein forming a pouring sub-assembly in accordance with the adaptor assembly of the present invention;

FIGS. 5 and 6 are cross-sectional views of the container cap of FIG. 4, illustrating constructions for use with spouts designed to meet standards for leaded and unleaded fuel nozzles, respectively;

DETAILED DESCRIPTION OF THE PREFERRED EMBODIMENTS

As noted, initially, the adaptor assembly in accordance with the present invention is designed to fulfill a variety of purposes, including: (1) pumping of liquids, such as fuel, from large capacity drums of the type having openings that are sealable by threaded bung-type closures; (2) pouring of liquids, such as fuel, from military-type Jerry Cans; (3) pumping of liquids, such as fuel, from military-type Jerry Cans; and (4) pumping of fuels from small capacity commercial-type containers of the type designed to receive internally threaded closure caps. Therefore, in the following description, the details of applicants' adaptor assembly will be described in connection with the discussion of its manner of use in each of the four noted environments.

Figure 1:
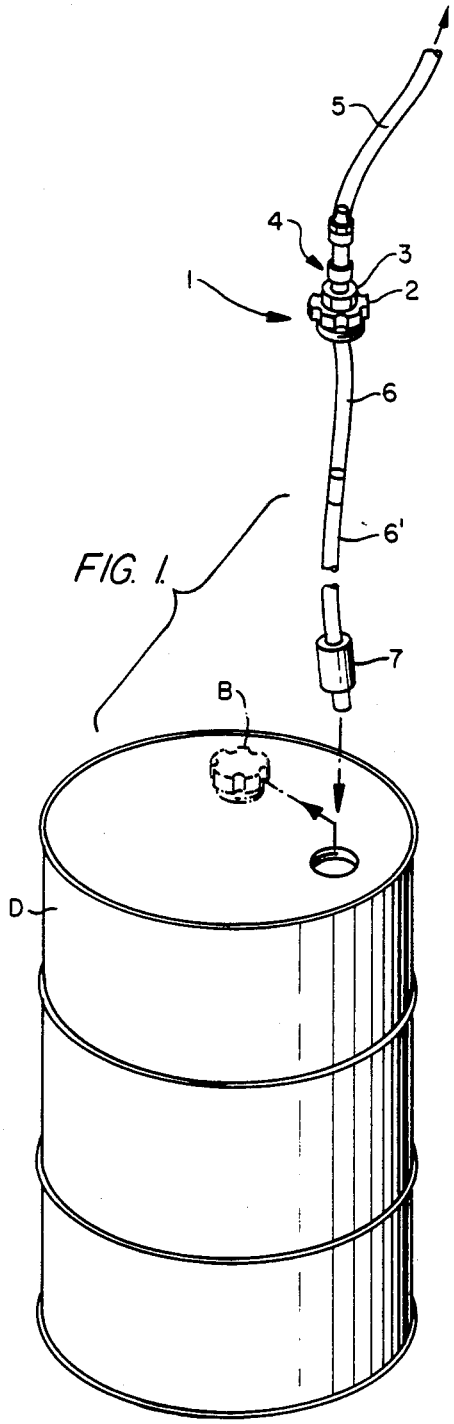
FIG. 1 is a perspective view illustrating the installation of an adaptor assembly in accordance with the present invention into a military fuel drum type container.

FIG. 1 shows the utilization of an adaptor assembly in accordance with the present invention, with a standard, large capacity drum, such as a standard military 55 gallon drum D. In order to pump fluids from such a drum D, the bung closure B is simply withdrawn and the entire adaptor assembly, indicated generally at 1, inserted into the bung-hole and secured. When so utilized, the adaptor assembly comprises a large diameter, container cap 2, a small diameter, coupling cap 3, a pump connector 4, which is connected at one end to cap 3 and at an opposite end to a tubing 5 communicating with a pump (not shown), a tubing section 6, which is connected at one end to the underside of cap 3 and, if conditions of usage warrant, at an opposite end to a further tubing section 6' and a, likewise, optional fuel filter 7.

Figure 2:
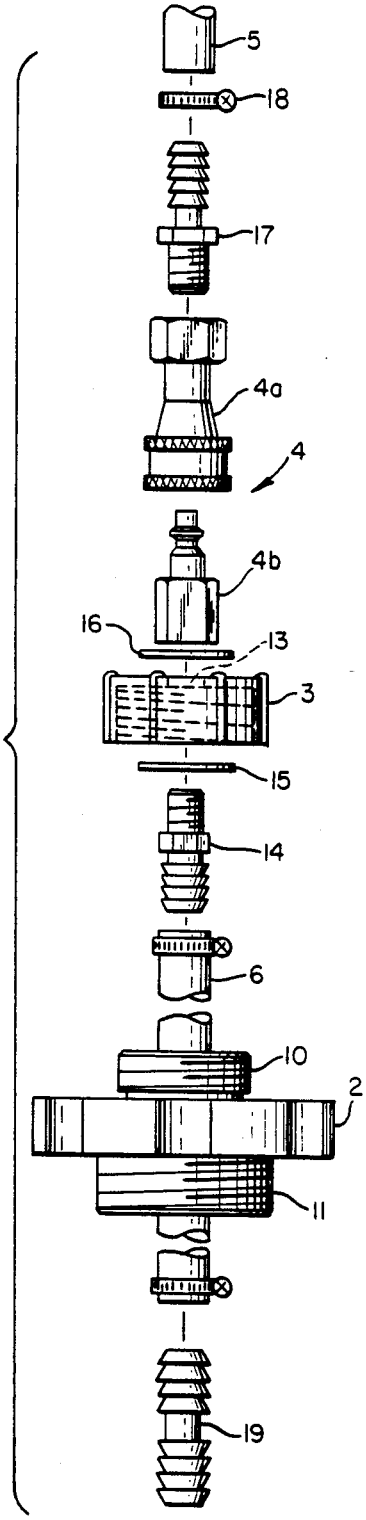
FIG. 2 is an exploded view of a preferred embodiment adaptor assembly in accordance with the present invention.

Turning now to FIG. 2, the details of the pumping adaptor assembly 1 will be described.

The large diameter, container cap 2 has top and bottom externally threaded tubular projections 10, 11, respectively, which are axially aligned with each other. The top threaded projection 10 has a lesser diameter than the bottom threaded projection 11. The threads 11 are adapted for mating with a standardized thread as utilized on drums and Jerry Cans which comply with U.S. military specifications. On the other hand, the threads on the projection 10, preferably correspond to that of an externally threaded opening as used on commercial, non-military gas containers. In particular, a two inch pipe thread of a straight eleven and a half threads per inch and a minimum of five full threads is utilized for projection 11, while, projection 10 may be approximately an inch and a half in diameter and have a heavier buttress type threading, as shown more clearly in FIGS. 5 and 6. As also shown in FIGS. 5 and 6, the top threaded projection 10 is provided with a tubular spout mounting projection 12. This spout mounting projection is disposed concentrically within top projection 10 so as to project toward the bottom projection 11, internally thereof.

The small diameter, coupling cap 3 has a peripheral wall that has an internal threading that is sized and shaped for threadingly seating upon the threads of the top projection 10 of container cap 2. Additionally, the top wall of the coupling cap 3 has an aperture 13 extending concentrically therethrough. A tubing connector 14, having a threaded upper end and a circumferentially ribbed lower end, is passed sequentially through a lower washer 15, the aperture 13, and an upper washer 16, and the pump connector 4 is then threaded onto the upper end of the tubing connector 14. In particular, in accordance with the preferred embodiment of FIG. 2, the pump connector 4 is a commercially available quick connect-disconnect type coupling (such as that manufactured and sold by a Aeroquip Company under Model No. FD45 - Series-04), in which case the tubing connector is threaded into the end of the male shut-off part 4*b* of the quick connect-disconnect shut-off coupling. Inasmuch as the quick connect-disconnect shut-off coupling is a commercially available part, which, in and of itself, is not part of the present invention, no detailed discussion of the construction of this part will be provided, apart from noting that female shut-off part 4*a* and male shut-off part 4*b* each assume a closed position when these parts are separated from each other, but assume an open position when the two parts are engaged with each other. The female shut-off part is connected, at its end opposite that which couples to male part 4*b*, to a pump via a fitting 17, which is similar to connector 14, and the tubing 5 is secured to the ribbed end of fitting 17 by a ring clamp or cable tie, 18, for example. Similarly, the tubing 6 is connected to the ribbed end of tubing connector 14 by a similar ring clamp or cable tie.

A dual ribbed end connector 19 may be connected to the opposite end of cable 6 by a similar ring clamp or cable tie in order to facilitate connection of tubing 6 to a further length of tubing 6', where the height of the container is such that tubing 6 (because it is of a length suitable for use with smaller containers, such as Jerry Cans and 1 to 2½ gallon gas cans), is inadequate. Likewise, when conditions of use warrant the use of a fuel filter, the fuel filter 7 may be connected, either directly to the end of tubing 6, or to the end of tubing 6', by a reduction fitting 19', a small section of hose 20 and another tie 18, as is illustrated in FIG. 3.

When the adaptor assembly 1 is to be utilized for gravity discharge pouring of the contents of, for example, a standard military Jerry Can, a tubular spout 21, of a size and shape designed for retention within the spout mounting projection 12, is inserted therein so as to be slideable between a retracted position (solid line position, FIG. 4) wherein the spout projects outwardly from the bottom projection 11 of the container cap 3, and a pouring position (dot-dash line, FIG. 4), wherein the spout projects outwardly from the top projection 10 of the container cap. Spout mounting projection 12 may be sized for either receipt of a spout 21 of a size designed to comply with government regulations concerning nozzles for a vehicle operating on leaded gasoline (FIG. 5), or a size corresponding to that required for nozzles used for filling unleaded gasoline into vehicles (FIG. 6).

In this regard, it is noted that the construction of the flexible tubing, tubing connector and clamping means shown in FIG. 2 takes into consideration the fact that the minimum inner diameter of a projection 12 for use with an unleaded fuel spout will be approximately 0.9 inches, since they must be received within or pass through this spout mounting projection 12 when the adaptor assembly 1 is to be utilized in the FIG. 2 configuration for pumping purposes, after removal of the spout 21.

Figure 7:
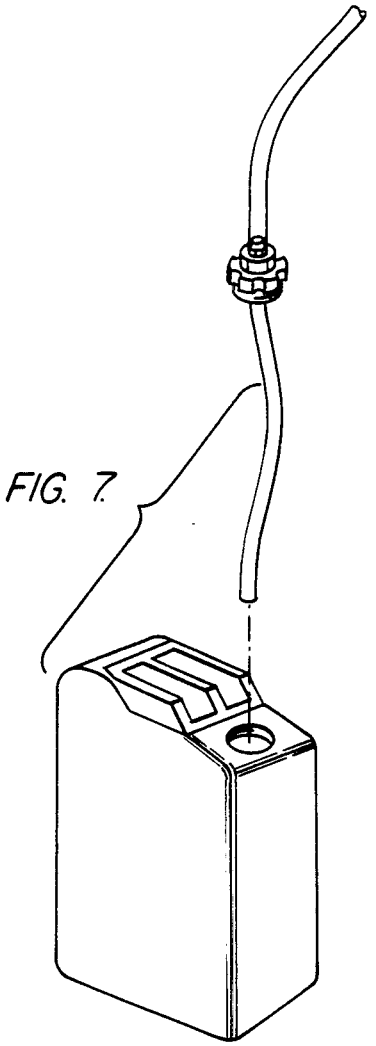
FIG. 7 is a perspective view illustrating use of the adaptor assembly of the present invention in conjunction with a Jerry Can type container.

The use of the adaptor assembly 1 for pumping of the contents of a Jerry Can is essentially the same as that for pumping the contents of a drum, except, as shown in FIG. 7, the extra length of tubing 6' and, optionally, also the fuel filter 7, are removed.

Still further, by designing the internal threading of the coupling cap 3 to correspond to that of a cap C, used to close the opening of a standard non-military gas container G (FIG. 8), the coupling cap 3, with the connectors 4, 14 and tubing 5, 6 attached, can be utilized, without the coupling cap 2 in order to pump-out the contents of such a standard gas container. Furthermore, on the other hand, the cap C can be used on the top projection 10 of the coupling cap 2 for closing same with the spout 21 retained therein in its retracted position. It is also pointed out that it is particularly advantageous to have the coupling cap 3 interchangeable with the closure cap of a dual-cap type closure of the type provided with a retractable pour spout as in the above-referenced co-pending U.S. application Ser. No. 259,165, in which case, not only it is possible to interchangeably utilize the closure cap and coupling cap, but also it would be possible to interchangeably utilize the same spout 21 with both the dual-cap on a standard non-military gas can and with the container cap of the present invention, since, in both instances, the spout would have a diameter designed to conform with government regulations for the size of nozzles to be utilized for dispensing leaded or unleaded fuel into a motor vehicle.

Figure 8:
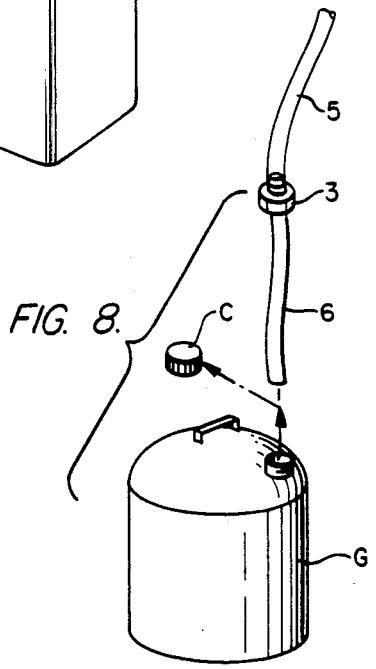
FIG. 8 is a perspective view illustrating use of a small diameter, coupling cap sub-assembly in conjunction with a conventional non-military type gas container.
Figure 9:
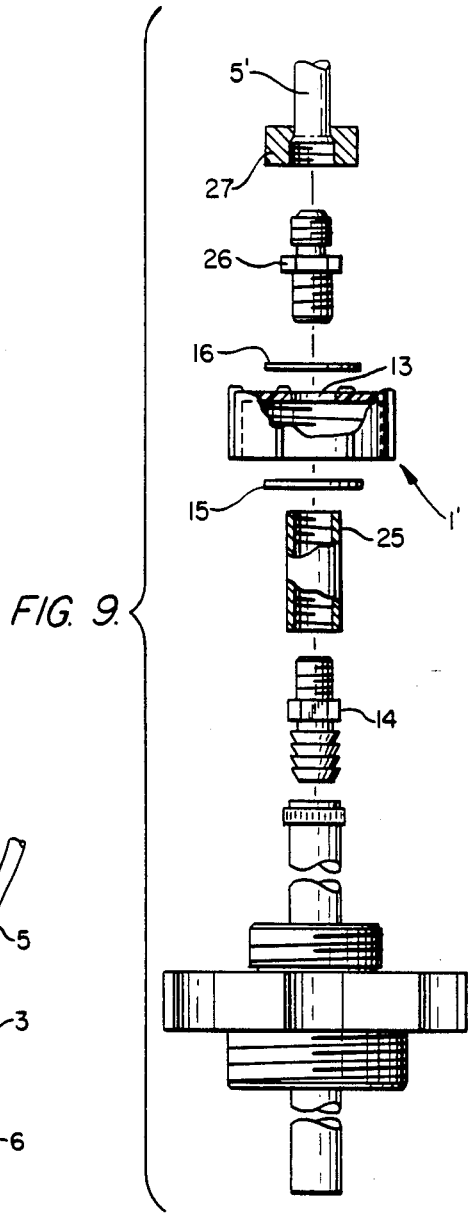
FIG. 9 is an exploded view of an adaptor assembly in accordance with a modified embodiment of the present invention.

It is also noted that, while FIGS. 7 and 8 have been described with reference to the embodiment of FIG. 2, these figures actually illustrate the modified embodiment of FIG. 9. That is, in accordance with the adaptor assembly embodiment of FIG. 9, a quick connect-disconnect type shut-off coupling is not utilized. Instead, the tubing connector 14 is threaded into one end of a threaded sleeve 25, while a threaded end of a fitting 26 is passed through washer 16, aperture 13 and washer 15, and then threaded into the opposite end of sleeve 25. Fitting 26 is of a conventional design and has a threaded upper portion which terminates in a tapered surface. This tapered surfaces receives, in a known manner, the flaired end of a tubing 5' which is received within a ring nut 26. Ring nut 26 is threaded onto the threads of fitting 26 so as to hold the flaired surface of tubing 5' in sealed relationship to the tapered end of fitting 26, for the purpose of establishing a connection to a pump (not shown). Since, with this embodiment, no shut-off valve arrangement is provided, in order that dirt will not enter into a container to which the assembly 1' is attached, when the tube 5' and nut 27 are removed, a conventional cap nut (not shown) would then be threaded onto the upper end of fitting 26.

From the foregoing, it should be readily apparent that the adaptor assembly of the present invention provides a simple and inexpensive means for achieving all of the objects noted above.

While we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. An adaptor assembly usable with a plurality of different types of containers and in a plurality of different configurations comprising:

(A) a large diameter, container cap having a top and a bottom externally threaded tubular projection extending in axial alignment from opposite sides thereof the top threaded projection being of a lesser diameter than the bottom threaded projection and being provided with a tubular spout mounting projection, said spout mounting projection being disposed concentrically therein so as to project toward said bottom projection, and wherein the threads of the bottom projection are adapted for mating with at least a first type of standardized container opening;

(B) a tubular spout sized and shaped for retention within said spout mounting projection in a manner permitting slideable movement theref between a retracted position, wherein said spout projects outwardly from the bottom projection of the container cap, and a pouring position, wherein said spout projects outwardly from the top projection of the container cap, and for detachment from container cap;

(C) a small diameter, coupling cap having an internally threaded peripheral wall extendng axially from a top wall thereof, the threading of said peripheral wall being sized and shaped for threadingly seating said coupling cap upon the threads of the top projection of said container cap and for mating with at least a second type of container, and said top wall having an aperture extending concentrically therethrough with a pump connector and a tubing connector projecting, respectively, from each of top and bottom sides thereof in alignment with said aperture;

(D) flexible tubing coupled to said tubing connector by a clamping means, said tube and clamping means being sized so as to be received within said spout mounting projection when said coupling cap is seated upon the top projection of the container cap with said spout detached;

wherein said container cap and tubular spout are usable together in a first configuration of said adapter assembly for pouring of fluids from at least said first type of container, wherein said container cap and said coupling cap are usble together in a second configuration of said adapter asembly for drawing of fluids from at least said first type of container, wherein said coupling cap is usable without said container cap in a third configuration of said adapter assembly for drawing of fluids from at least said second type of container and wherein a closure cap from at least said second type of container is usable with said container cap for sealing of at least said first type of container.

2. An adaptor assembly according to claim 1, wherein said pump connector is a quick connect-disconnect type shut-off coupling.

3. An adaptor assembly according to claim 2, wherein said shut-off coupling comprises male and female shut-off parts, a first one of which is attached to said coupling cap and the other of which is connectable at one end to a pump and at an opposite end to said first shut-off part.

4. An adaptor assembly according to claim 1, wherein said assembly comprises at least one selectively usable length of additional flexible tubing and means for securement thereof to the flexible tubing coupled to the tubing connector, whereby said assembly is adaptable for use with containers of different height.

5. An adapter assembly according to claim 4, wherein said first type of container comprises fuel drums and Jerry Cans conforming with U.S. military specifications, the threads of the bottom projection of the container cap being sized for mating with U.S. military specification fuel drum and Jerry Can container bung holes, and said assembly further comprises a fuel filter for connection to an end of the flexible tubing or the additional flexible tubing.

* * * * *